US007862455B1

(12) United States Patent
Ratmiroff

(10) Patent No.: US 7,862,455 B1
(45) Date of Patent: Jan. 4, 2011

(54) STRINGING SANDWICH, AN APPARATUS THAT LAYS STRINGS ON TOP OF EACH OTHER WITHIN A FRAME OF A RACQUET

(76) Inventor: Alberto Ratmiroff, 10200 Independence Pkwy., Apt. #108, Plano, TX (US) 75025

( * ) Notice: Subject to any disclaimer, the term of this patent is extended or adjusted under 35 U.S.C. 154(b) by 67 days.

(21) Appl. No.: 12/387,067

(22) Filed: Apr. 27, 2009

Related U.S. Application Data

(60) Provisional application No. 61/125,858, filed on Apr. 30, 2008.

(51) Int. Cl.
*A63B 51/00* (2006.01)
*A63B 51/14* (2006.01)

(52) U.S. Cl. ..... 473/553; 473/557

(58) Field of Classification Search ..... 473/524, 473/553, 555–557; 28/151
See application file for complete search history.

(56) References Cited

U.S. PATENT DOCUMENTS 2,156,092 A * 4/1939 Johnson ..... 139/33
2,268,276 A * 12/1941 Caro et al. ..... 139/33
3,994,496 A * 11/1976 Burchett ..... 473/557
4,082,272 A * 4/1978 Garver ..... 473/557
4,270,752 A * 6/1981 Strelow ..... 473/557
4,339,131 A * 7/1982 Balaban ..... 473/557
4,439,908 A * 4/1984 McDonald ..... 29/446
4,452,452 A * 6/1984 Timmer ..... 473/557
4,456,254 A * 6/1984 McDonald ..... 473/556

FOREIGN PATENT DOCUMENTS

FR 2584298 A3 * 1/1987
WO WO 9518654 A1 * 7/1995

* cited by examiner

*Primary Examiner*—Raleigh W. Chiu

(57) ABSTRACT

An apparatus that lays strings on top of each other within a frame; the overlying of the strings, once the process is finish, will create the arrays of intersections between the vertical and horizontal strings that create the net in a racquet, such as a tennis racquet, or squash racquet. The apparatus is new, very useful and has of a main section, a complementary overlap cover for the main section, a way of securing and undoing the main section to and from the frame of the racquet, and an inlet and outlet passage for the strings to and from the main section. In addition, a preferred embodiment includes the main section with vertical and horizontal routes that overpass each other made of transparent plastic, and consisting of any number of vertical and horizontal routes. A preferred embodiment includes the complementary overlap with a design of any geometric shape.

6 Claims, 5 Drawing Sheets

STRINGING SANDWICH, AN APPARATUS THAT LAYS STRINGS ON TOP OF EACH OTHER WITHIN A FRAME OF A RACQUET

CROSS REFERENCE TO RELATED APPLICATIONS

This application is based on provisional application Ser. No. 61/125,858, filed on Apr. 30, 2008.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of stringing tennis racquets and more specifically to an apparatus that overlaps and lays strings in place within a frame of a racquet before or during the final process of applying pressure to the strings on a stringing machine.

Upon research on the subject in the USPTO website for revelant prior information on the topic, I was not able to cite a prior patent number or idea; as a result, I am including my background experience as a starting point of reference.

Tennis racquets have been stringed by hand since I can remember. I recall when I was a small boy and that was 48 years ago, that racquets were made of bamboo, wood and that they were strung by hand. I remember that the strings were push in thru one of the openings in one side of the racquet and taken out of the racquet on the other side of the frame. The stringing process was 100 percent manual and the mistakes made in the process were the responsibility of the operators only.

The stringing process or work done on a racquet is performed usually by a person who has experience in the stringing art. The overpass or overlaying of the strings between them within the frame of a racquet is done by hand right now, and maybe it will still be done by hand even after this patent invention is presented to the patent office, by the writer of this paper. The person in charge of stringing racquets, usually has to lift or pushed aside a little bit the string that is in that place, in that specific spot on the racquet, as a way to make space for the other string that is coming through out on the other route, so that the overlaying or overpass process between the strings can take place.

Usually all the vertical strings are push first, then all the horizontal string are push later; then the overlaying process between vertical and horizontal strings is done by hand, one at a time by the operator o person in charge of the stringing process. Each union or intersection between the vertical and horizontal strings are done one by one by hand, a process that is time consuming and sometimes very stressful to the operator.

The old process it is manually in its totality, it is time consuming and mistakes are made and a learning curve is involved for the process. The operator relies mostly in the use of its hands for the overpass or overlying process between the strings. The process usually was made at the stringing machine were the final pressure to the strings was deliver to the strings.

The Stringing Sandwich, with a predetermined route constructed of a geometric shape or figure offers the opportunity to overlie the strings without the need of touch the strings with the hands between them, because of a predetermined geometric pattern that has the capability to overlie the strings between them. The process is now made simpler, convenient and very appealing to the user; usually a very simple hand movement will do the trick to get the process started and finished.

The article of manufacture is portable and the process for its use can be done at any location, even including the final destination were racquets are taken to be strung, the Pro-Shop were the stringing pressure machine is present.

BRIEF SUMMARY OF THE INVENTION

The primary object of the invention is to provide a product that will guide/overlie the strings on top of each other within a frame of a racquet, thus providing an opportunity to avoid manual mistakes.

Another object of the invention is to provide a product that will assist the user in the stringing process before a racquet is taken to the stringing machine for the final tension on the strings, thus saving time and work.

Another object of the invention is to provide a product that is portable, easy to transport to any location.

A further object of the invention is to provide a product that is easy to assemble and disassemble, thus convenient to work with and less stressful to the user.

Yet another object of the invention is to provide a product that is made of transparent plastic, thus allowing the user to visualize and to asses progress.

Still yet another object of the invention is to provide a product that can be use for sales promotion purposes, such as designs, ideas and logos can be incorporated into the product.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus that lays strings on top of each other within a frame of a racquet comprising: a main section with vertical and horizontal routes that overpass each other, a complementary overlap cover for the vertical and horizontal routes of the main section, a means of securing and undoing the main section to and from the frame of the racquet, and an inlet and outlet means for the strings to and from the main section. In a preferred invention the main section and the complementary overlap cover for the main section would both be made of any of many geometric shapes available for its function. The main section would consist of any number of vertical and horizontal routes, and usually made of transparent plastic for better work progress.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
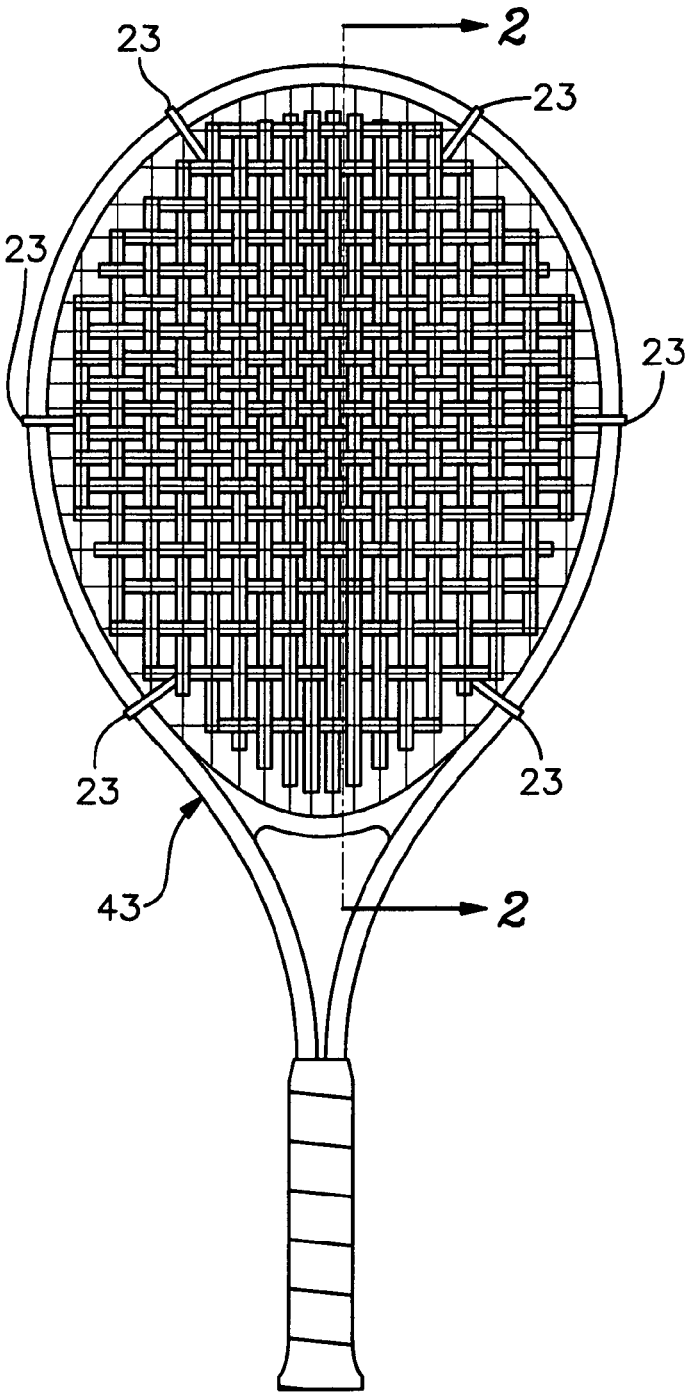
FIG. 1 is a perspective view of a tennis racquet and the apparatus grip to the frame of the racquet, showing the way the strings would look inside of the apparatus when the overlying process has finished.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

A tennis racquet is basically a hand grip, a frame and an array of strings that are intertwined within each-other inside a frame of a racquet, and by taken all the parts together the concept of a tennis racquet is form. We all use a tennis racquet when we want to play tennis or when we just want to hit a few tennis balls over here and over there, like in the back of your garage, or against a wall. We usually play tennis in a club or tennis facilities were all the physical facilities are present, like a tennis court with a net, some lights that work. How we play tennis may not be that important as long as we can hit the ball over the net back and forth to our partner and the partner can hit the ball back to us. Sometimes we don't need a partner and we just hit the ball against the wall at the club. Why we play is a question of choices, hobbies, likes and dislikes; some play for fun and others play for the exercise while others play for the sport and for the excitement of victory.

We string tennis racquets when the strings break or when the tennis racquet loses its bouncing power or are too loose. The strings loose pressure or pounds of pressure and the ball fail to bounce off as it used to bounce off before. Then, we break the strings, or maybe the strings break after a good smacking whack with the racquet over the net. The point is that strings break and that the need to string a racquet arises anywhere were we play tennis, but not always in the same place where a Pro-Shop or Tennis Shop is.

Now, in a racquet that is strung and that is ready for use, the strings have a predetermined tension or pressure among them; also the strings are intertwined within each-other in a predetermined pattern for bouncing purposes. Bouncing purposes means that, the tennis ball would bounce off from the racquet and toward the direction that the racquet is aimed at the moment of impact by a person. The tension applied to the strings is usually generated by a mechanical or electronically machine depending of the Pro-Shop were you take the racquet. A person is responsible for manually sliding one string at a time through each one of the openings on the racquet. About half of the strings that are in place within the racquet travel in the vertical direction, that is up and down, while the rest of the strings that are in place within the racquet travel in the horizontal direction. Not all racquets are the same, in general, racquets can have a number of possible combinations between vertical and horizontal strings, for simplicity, we can refer to one example as: 18×19. In our example: a racquet that has 18 strings traveling in the vertical direction and 19 strings traveling in the horizontal direction is a simple racquet. Now, each string that travels in the vertical direction has to come into contact with a horizontal string by default, well that is if you don't make a mistake in the process of stringing the racquet. The path where the two strings cross is called an intersection, where one string is laying or resting on top of the other string. The intersection can be formed by only TWO possible outcomes: 1) the vertical string is laying or resting on top of the horizontal string; and, 2) the horizontal string is laying or resting on top of the vertical string. These two outcomes apply to all the intersections between the entire vertical and horizontal strings within a frame of a tennis racquet and racquets in general, like a squash racquet and a racquetball racquet. If we take all the strings with their respective intersections between them, then the concept of a web of strings is visualized well or more easily perceive for a viewer. One (1) vertical string can make contact with (19) horizontal strings in the web of intersections within a frame of a racquet most of the time; so if we have 18 vertical strings and 19 horizontal strings in a theoretical tennis racquet, then the number of possible intersections between the strings can be quite a large number. Mistakes can happen in this manual process, and they happen.

The present manual process of stringing a racquet is simple and has a series of steps:

1) When the strings break or are cut by a person, a person or the person who owns the racquet would usually take the racquet to string to a place. At the present moment the most commonly place to take a racquet to string is the Pro-Shop or Tennis Shop, were the Stringing Machine is. The Stringing Machine is a machine that applies the final pressure to the strings once the strings are in place secure within the frame of the tennis racquet.

2) A person, who has been trained in the art, will usually work on the tennis racquet from start to finish, until the racquet is finish. The staff at the Pro-Shop will usually cut off the remainder strings of the frame of the racquet with a cutter or a scissor. Then the racquet with no strings is placed on the stringing machine, were some clamps grab the frame of the racquet to the machine in a firmly matter.

3) Even though the next description is not all inclusive, the next stringing process will lay down a base of a manual stringing process by an operator, who knows what he/she is doing.

The person doing the work will usually start with one vertical string first. He will slice one end of a long roll of material that is use as a string through one of the openings into the frame of the racquet, usually in the middle SOUTH end of the frame, in the vertical NORTH direction. The person will push until the string is out on the other end side of the frame. The string is then fixed into position with the help of some kind of position clamps to the frame, until the person places the extension of the string into the Stringing Machine. The machine once activated by the operator will pull the string with an X amount of pounds of pressure or stretch the string thin with an X amount of pounds of pressure, say 60 lbs of pressure. Once the string is pull by the machine to the required preset pressure and the string stretches, the operator will usually secure that string and start moving the part of the string that is not yet stretch into the opposite NORTH direction through the next hole or opening inside the frame of the racquet. The purpose is to fill all the vertical openings on the frame with the roll of material we call string. The process is repeated once again, now from the NORTH to SOUTH, until that string is secured and with the required pressure to the frame of the racquet, on the other side of the frame of the racquet. Once again, the operator repeats the sequence, until the next string is secure and in place within the frame of the racquet. The process will repeated by the operator until all the vertical strings are secure within the frame of the racquet with the required pounds of pressure for each string.

Now, that the vertical strings are in place, secure and with their required pressure, the operator now moves to work with the horizontal strings and with the manual process of intertwining the strings together manually. The operator now and with the help of his hand places the horizontal string through one opening on the side of the frame of the racquet. The horizontal string will be placed over the vertical string, or maybe under the vertical string, depending on the pattern to follow by the operator on this racquet. The operator usually does one intersection at the time, by hand until all the intersections are done in that horizontal string in a proper sequence, one up, one down, one up, one down. Later, the operator will use the stringing machine to apply pressure to that horizontal string and then secure the string to the frame once more time. The process usually starts from the WEST end of the frame to the EAST end of the frame, but not always. The horizontal string is now ready to be secure to the frame of the racquet by the operator; now the operator can use the stringing machine to apply the required pounds of pressure to the horizontal string on that specific hole or opening on the frame. Following the same logic, now the operator performs the same work on all the remaining horizontal strings on the remaining vertical strings and openings of the frame, switching from WEST to EAST, and then from EAST to WEST, until all the strings are in place and secure to the frame, with their respective intersections at all points of contact between the horizontal and vertical strings. The process is repeated until all the horizontal strings with their intersections are done and the tip of the string comes out in the end of the frame of the last horizontal opening.

4) Finally, now the operator makes a couple of knots to tie the loose ends of some strings to each other within the frame of the racquet, so that the intersections will not come loose from the frame of the racquet, and now the racquet is ready to be taken out of the stringing machine. The racquet is now ready to be used by the owner or future player.

Now, that we know a little about tennis and the racquet used in that sport. Let's turn our attention to FIG. 1; a front view of a racquet 43 is shown. The racquet 43 has a hand grip, also has a frame with many vertical and horizontal holes within the frame and a series of vertical and horizontal strings that are interconnected within the frame of the tennis racquet. All the strings taken together form an array of intersections that create a net or web within the frame, on this case a racquet with 18 vertical and 19 horizontal strings. Please count the number of strings to make sure that we have 18×19 strings all together. It cannot be seen from this drawing, but usually the strings have a predetermine tension or pressure that is distribute along the length of the string, usually 60 lbs. of pressure.

Figure 2:
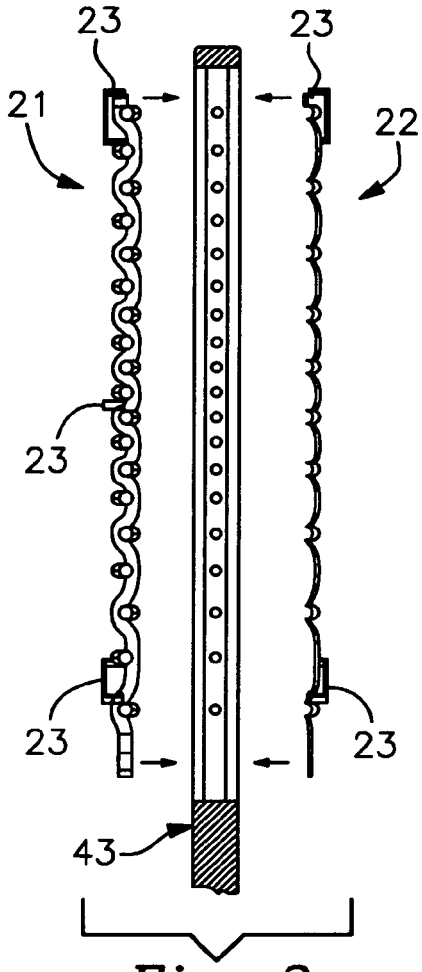
FIG. 2 is the side view of a racquet and of the article of manufacture showing the main section with the complementary part cover for the main section, showing how the two parts can come or fit together to form a unit or a solid apparatus.

On FIG. 2, we see a tennis racquet 43 that is drawn sideways, with many holes or openings along the side of its frame. This holes or openings are the entrance for the strings to the inside pathways along the frame of the racquet. On this particular racquet we can see 19 horizontal holes, openings along the side of the frame of this tennis racquet, please count the holes so that we can make sure that we have 19 openings for our future horizontal strings.

We have already introduce the foundation to the stringing process and how the manual part of the process impacts the outcome, a racquet with no mistakes, with all the intersections and with the right pressure along its strings. In the manual process of stringing a tennis racquet, the manual manipulation of lifting one string and placing that string, either on top of the next string, or on the bottom of the next string, is usually very tedious and very mistake prone, by the operator. Usually an operator will miss an intersection and place one horizontal string on the bottom of the vertical strings, either two or three times in the same row, or make a very similar mistake. Usually this mistake will show up when a tennis player hits the ball and the ball bounces off in a funny way or direction on the court.

In the stringing process of a racquet, the operator plays such an important part in that process, that the present idea or apparatus was thought about with that person in mind. Also the idea or apparatus was thought for all the persons that string racquets on a regular basis.

A continuation we are going to talk about an apparatus that lays strings on top of each other within a frame of a racquet and comprising of: a main section with vertical and horizontal routes that overpass each other; a complementary overlap cover for the vertical and horizontal routes of the main section; a means of securing and undoing the main section to and from the frame of the racquet; and an inlet and outlet means for the strings to and from the main section. We call the apparatus the Stringing Sandwich.

The Stringing Sandwich is basically a series of vertical and horizontal pathways or routes, that are made of a geometric figure, that allow the strings to travel along its corridors in a predetermine pattern and allow for the creations of the intersections between the strings along its way. Once the intersections are created within the frame of the racquet, the operator takes apart the Stringing Sandwich and the strings with all its intersections stay put or in place within the frame of the tennis racquet. The scenario is as follow: empty racquet that needs strings; operator puts apparatus together into the frame; operator pushes strings through the openings of the apparatus, after all strings are in place, the operator takes apart apparatus of the frame; and the strings stay put with all its intersections within the frame of the racquet, end.

What is new is an apparatus that is put into place within the frame of a tennis racquet and that will do the job of overlaying the strings on top of each other or overlapping the strings on top of each other at each possible intersection between the vertical and horizontal strings on a racquet in a direct and simple way with minimal supervision of an operator. The manual lifting and placing of the strings on top of each other as it was explain before in the previous paragraphs is almost eliminated by a new mechanical and practical apparatus that works like a sandwich, the Stringing Sandwich. The sandwich has to parts, one bottom and one top; and both parts work together to allow for the traveling of the strings through its geometric paths, routes to create the intersections that are required between the strings that travel in a North-South direction and the strings that travel in the East-West direction, within the frame. The apparatus or Stringing Sandwich is grip to the frame of the tennis racquet thru a series of hooks that act similar to a hanger or cloth hanger. The grip/hanger is place on the frame on different places and the contour of the grip adapts to the shape of the frame and rests there in a secure and firm position, while in use.

Another point of importance; the strings have one entry inlet into the apparatus and one exit outlet from the apparatus. The operator installs the apparatus into the frame of the racquet by clipping together the bottom part and the upper part of the Stringing Sandwich together with the help of the grips; see FIG. 2, 21, 22, 23. The number 21 represents the bottom part of the Stringing Sandwich, the number 22 represents the upper part of the Stringing Sandwich and the number 23 represents the grips that are use to secure the Stringing Sandwich to the frame of the racquet. The how the strings are displaced out altogether from the apparatus is explained in detail later on.

An advantage of the sandwich is that it can be use before the racquet is taken to the Pro-Shop or at the Pro-Shop, either way. The Stringing Sandwich allows the owner or the operator the option to string a tennis racquet anywhere where the strings break on the racquet. Let me say that again, the Stringing Sandwich lets you string a racquet, that is, to have all the strings inside within the frame of the tennis racquet with all its intersections but with no pressure deliver to the strings, before the racquet is physically taken to the Pro-Shop. The final pressure can then be applied once the racquet arrives at the Pro-Shop. Advantage in general, almost all the work is done before the racquet reaches the Pro-Shop or Tennis Shop.

Let assume that the Stringing Sandwich is being use by a person or by an operator, and then something goes wrong in the stringing work; now what?, well, since the apparatus is going to be made of a transparent plastic, the operator is going to be able to see where the mistake is and go to that specific intersection and lift and fix and then proceed again with the work.

The Stringing Sandwich is prone to logo, advertisements, ideas and designs by the part of the manufactures of racquets, in general. The apparatus can be adapted to the design and contour of the racquet in question, different designs might be able to be produced for different brand names and racquets.

In detail now, in FIG. 1 we can appreciate the main section with vertical and horizontal routes that overpass each other with a complementary overlap cover for the vertical and horizontal routes of the main section in one picture or drawing. The two parts of the Stringing Sandwich are working together embracing the strings along its contour and directing traffic to the strings along its routes or paths. The means of securing and undoing the main section to and from the frame of the racquet is illustrated by a series of grips/handles, 23, in FIG. 1 and in FIG. 2. As you can see the main section fits well within the frame of the tennis racquet, it is adapted to follow the number of vertical and horizontal routes and corridors that make a tennis racquet. Sometimes the main section may not be a perfect fit to the design of the tennis racquet, since the design of the tennis racquet may not allow for that perfect fit, the fit between the geometric routes and the holes or openings on the frame of the racquet. In other words, a perfect fit may not be 100% possible, but a good fit is possible; since some intersections are so close to the frame of the racquet that the apparatus may need of the help the operator. The operator may be force to input those intersections by hand, one by one, in those tight spots difficult to reach by the apparatus or Stringing Sandwich.

Now we pass to FIG. 2, a side view of the racquet and the main section with its complementary overlap cover for the vertical and horizontal routes in separate parts, taken apart, 21, 22. As you can see the two parts will fit inside or within the frame of the racquet, and the means of securing and undoing the main section to and from the frame are illustrated by a series of grips, 23. The grips complement the bottom part and the upper part of the apparatus; also the grips matchlock to each other before or during the attachment to the frame of the tennis racquet. The two parts of the grips, one from the bottom part and the one from the upper part are both going to be design so that both parts engage each other as a way to keep the apparatus as a unit, when in place to the frame of the tennis racquet. The design of the complementary overlay cover is of the same geometric design as the main section and made also of transparent plastic. If the main section has an oval type shape, then the complementary overlay cover would need an oval type shape as a means to complement the main section for proper functioning.

Figure 3:
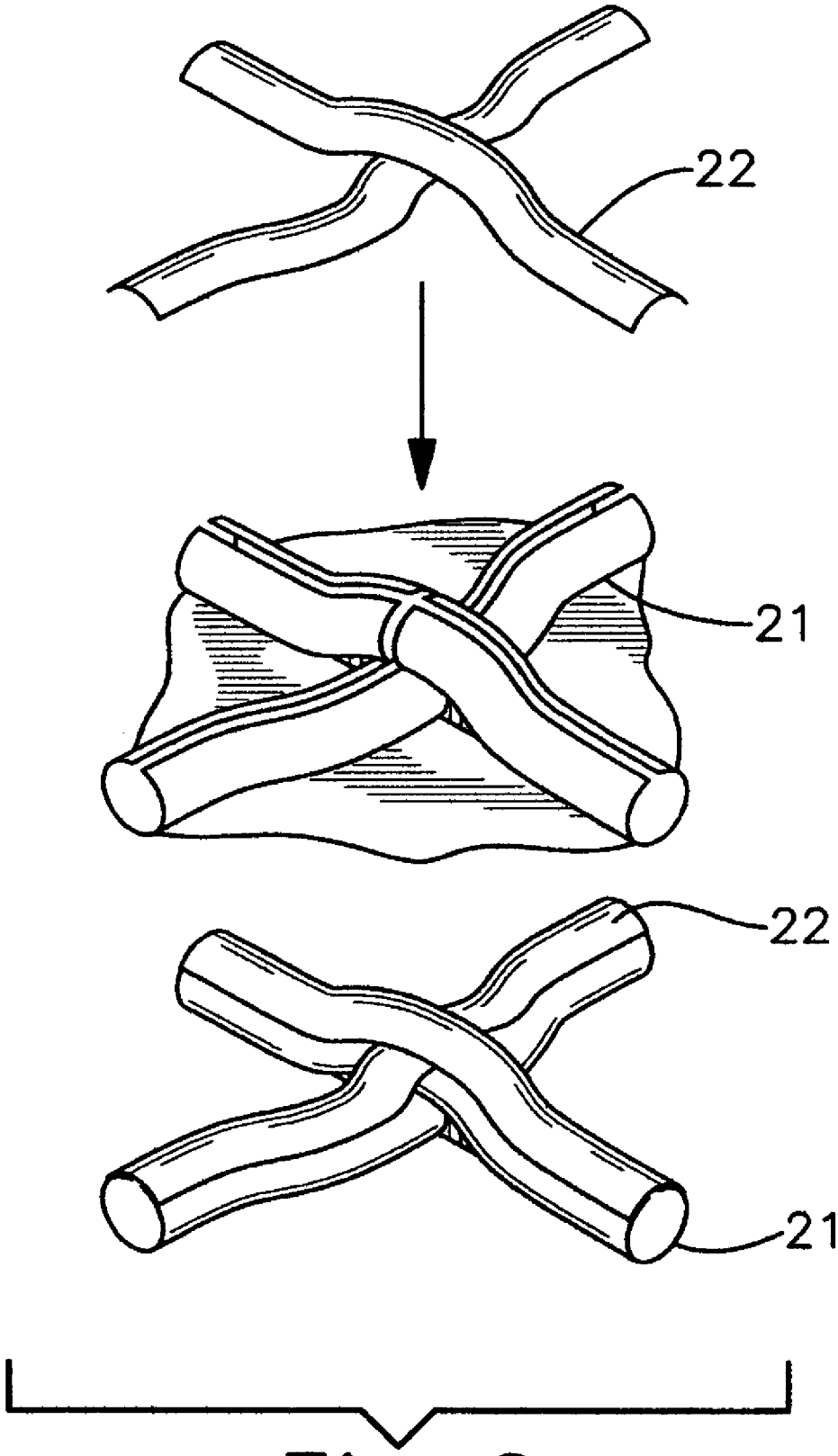
FIG. 3 shows the process of putting the apparatus together, including the exit outlet for the strings and the complementary part cover for the main section that overlaps and closes the exit on the main section for the strings, when the apparatus is in use.

Even in more detail, in FIG. 3, we see an intersection of the main section 21 and of the complementary overlap cover for the vertical and horizontal routes 22 in a close-up, then in detail together, 21, 22. The main section 21 shows an intersection with one vertical route and one horizontal route with some openings on the top and on the side of its routes, these are the inlet and outlet means for the strings to and from the main section of the Stringing Sandwich. Also in FIG. 3, we can appreciate that the main section has a small ground floor base were the vertical and horizontal routes rest for support and enhanced mobility of the apparatus in general. If we follow the logic of the drawing, we see that the complementary overlap cover covers the openings on top of the main section in its totality and that both pieces together form a cohesive unit or apparatus. The openings on top of the main section have a purpose and the complementary overlap cover fits and complements the design of the main section in general terms. On this specific example, you can appreciate a circular or cylinder type vertical and horizontal route. Why? Well, strings need to follow a path of least resistance when they are inside of the route, either in the vertical or horizontal route. The geometric design of the routes allows for a smooth travel inside of the route for the strings, in theory, that is in a theoretical diagram. The design for an apparatus for a specific racquet will need a degree of leeway when choosing the type of geometric figure to use for its routes. Some designs may not benefit from a cylinder or circular geometric route, so the need to include other geometric alternatives comes into place, like for example: on oval, a rectangle, a triangle, a pentagon, or a hybrid of some kind between different geometric figures. The string will behave different on different types of geometric routes; the string will tend to flow or travel inside the geometric route in a semicircle type of movement or in a zigzag type of movement, or maybe both together at the same time. The string will tend to exit the geometric route if it had a chance, so what we do is to negate or not allow for a chance or possibility on the apparatus. The main section has a complementary overlay cover for that specific reason, to minimize or eliminate the possibility that the string will exit the route before it has exit the other end of the route, of the path or corridor, see FIG. 3.

Only when all the strings are in place and only when all the intersections have been formed within the apparatus or Stringing Sandwich, is when the operator will take off the complementary overlay cover from the main section on the apparatus, and only at that moment in time, is when the complementary overlay cover will allow the openings on top of the main section to be exposed to the strings and to all the intersections that were created within the frame of the tennis racquet.

The operation of the Stringing Sandwich is simple: first, you have a racquet with no strings that needs some strings on its frame; second, you can use the apparatus before you take the racquet to the Pro-Shop or you can use the apparatus at the Pro-Shop; third, you insert the strings following the pattern for that specific racquet; fourth, you observe and decide when all the strings are in place with all their intersections, then undo the apparatus from the frame of the racquet and presto, all the strings are within the frame of the racquet with all the intersections. The tension will be applied at the Pro-Shop or at the Tennis Shop where the stringing machine is, for all the racquets, no matter where they were strung.

Now, a string just broke in a tennis racquet, the need for a new set of strings in required. The racquet with no strings would look like a racquet without anything in the middle of its frame, empty. If a decision to use the Stringing Sandwich is done at that moment in time, then usually the person who owns the racquet will go and get a set of pliers and cut off all the remainder strings that are left on the frame of the tennis racquet. If the person in charge decides to wait until the Pro-Shop, then, nothing happens until the racquet reaches the Pro-Shop. Assuming now the first scenario; the person has now made a decision to use the apparatus or the Stringing Sandwich for the first time. The racquet in need for a new set of strings would look like the racquet in FIG. 2, 43; the racquet is facing sideways and waiting for the two parts of the apparatus, 21, 22. In FIG. 2 the parts: a main section with vertical and horizontal routes that overpass each other; a complementary overlap cover for the vertical and horizontal routes of the main section; a means of securing and undoing the main section to and from the frame of the racquet are seen in the context of the racquet, 43, 21, 22, 23. The Stringing Sandwich is ready to be snap into place onto the frame of the racquet. The means of securing the main section with its complimentary overlap cover to the frame of the racquet are trigger by the operator and presto, the apparatus is in place around the frame of the racquet. We have to mention that the number and place and design of the means to secure the main section and its complementary overlay cover will change from racquet to racquet and from design to design, since no all racquets are made the same way. Let me explain: in our example at the beginning of this paper, we had a racquet with 18×19 routes, this specific number of vertical and horizontal routes are the foundation for the design in FIG. 1 and in FIG. 2 for that racquet, 43. On the market now days, there are many types of racquets with a different set of vertical and horizontal routes, such as 19×21; 22×24; others. The point to make is that the number of grips to secure the apparatus to the frame of the racquet will change given the number of vertical and horizontal routes and design for that specific racquet.

The sequence for putting together the apparatus is described in FIG. 3, where the main section 21 and its complementary overlay cover 22 are depicted in a sample intersection, and then again together, when both are in close contact again in FIG. 3, 22, 21. The routes for the vertical and horizontal corridors are now ready to be use by the operator and the set of strings. Let's assume that the operator has a new set of strings that are asymmetrical and wider than the normal set of strings on the market today; (the question comes to mind is and the answer that comes out is), the present cylinder design and circle type vertical and horizontal route cannot handle the strings and the strings get stuck half way into the corridor, route or path. This scenario is possible and very realistic; so as a way to offer a solution to a design problem, we have open the opportunity for other types of geometric design routes for the apparatus or Stringing Sandwich. There are a endless number of possible geometric figures and combinations of geometric figures in theory; so what we have done is to include a few samples like in FIG. 6, FIG. 7, FIG. 8, FIG. 9, FIG. 10, FIG. 11, FIG. 12. The main section and its complementary overlay cover can be of any geometric figure and/or hybrid that will help increase the capacity to advance of the string and decrease route resistance to the string once inside the route, corridor, path or avenue.

At this moment, the apparatus is placed in place on the frame of the tennis racquet. Remember, now also, that the apparatus is made of transparent plastic, which allows the person who is working on the racquet to see and appreciate the process of the strings through its vertical and horizontal routes.

Now to the core of the Stringing Sandwich, the main advantage of the apparatus and how it does what it does! We know from FIG. 3 that the routes have an inlet and an outlet means for the strings to and from the main section. The openings on top of the vertical and horizontal routes are the Outlet means for the strings, once the strings are in place and all the intersections are in their proper place within the frame, is when these openings come into play, usually at the end of the work. Also, you can see that the openings are covered by the complementary overlay cover 22 for the main section 21, see FIG. 3.

Figure 4:
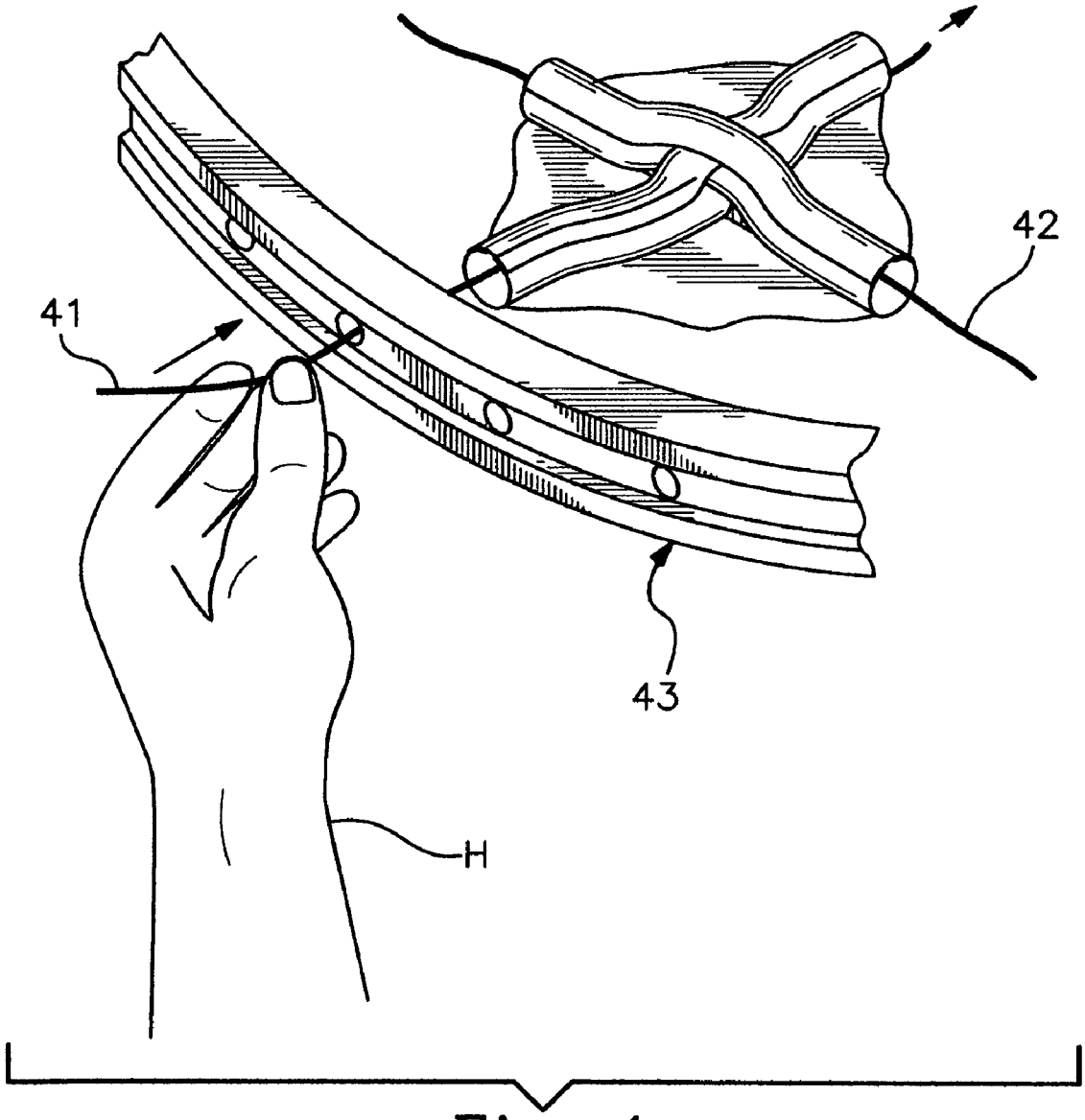
FIG. 4 shows how a simple straight hand movement is use to push the string thru one opening in the frame to the route and to the other side of the frame.

Now let's take a look at FIG. 4; the drawing shows a person's hand H, a frame of a racquet 43, a sample intersection of the vertical and horizontal routes together, a vertical string going through a vertical route 41, and a horizontal string going through a horizontal route 42. Since this is a sample intersection of the apparatus, please keep in mind an imagined the big picture. The sequences of intersections will alternate in the vertical and horizontal routes. For example: in a typical vertical route the string will encounter 19 horizontal other strings upon it path; the vertical string will go in a upward movement and over the horizontal string because the apparatus dictates the path to follow, given the design, see FIG. 4, 41; then on the next intersection the string will follow the design of the apparatus and switch and the vertical string would go under the horizontal string this time, then on the next intersection the sequence would alternate again and the vertical string would go over the horizontal string again, because the apparatus has a predetermined design and pattern that allows for the switching to take place in the first place.

The same pattern would happen when a horizontal string encounters 18 vertical other strings along its path; the apparatus would dictate the sequence of placement positions for the horizontal string in that specific horizontal route, always alternating positions with the vertical string. This pattern will happen all over the apparatus in all the intersections within a frame of a tennis racquet. The manual work of lifting one string and placing that string over or under the next string has been replaced by an apparatus that does this work in a predetermined pattern, here the advantage of the apparatus.

Now that the big picture is present, let's continue. The operator usually start in the NORTH-SOUTH side of the frame, then the operator grabs the tip of the string or tip of the reel of string and introduces the string through the hole in the racquet and through the vertical route going NORTH-SOUTH 41, see FIG. 4, with one simple straight hand movement, H. As you can see, the operator will insert the string thru an INLET MEANS of the route, then the string would travel in a straight line going in a wave type motion under the first intersection, then above in the next intersection, then under in the next intersection, then above in the next intersection, until the string reaches the end of the OUTLET MEANS at the end of that route. Now, please see, that the INLET AND OUTLET idea can change directions and that the OUTLET becomes the INLET MEANS if you start from the SOUTH END of the route in the first place, on the other side. With that in mind, lets continue; once the string comes out of the route in the south end of the route, then the operator grabs the tip of the string and makes an U-turn and introduces the string back into the next hole on the frame and into the next vertical route that is going in the SOUTH-NORTH direction, opposite of what we just did. We are assuming that the tensions that have to be applied to the strings are not going to be applied until the racquet reaches the Pro-shop, remember.

We have 18 vertical strings in our sample racquet on this example, so the operator is going to insert 18 times the tip of the string into the vertical holes on the frame of the racquet 18 times, until all the vertical strings have reached their destinations, secure and waiting for their counterpart horizontal strings to come into role and do their acting part on this play, on the apparatus or Stringing Sandwich.

Continuing with the story; once all the vertical strings are in place and secure on their place, the horizontal strings come in scene. The operator is now ready to begin inserting the horizontal string thru one of the horizontal holes in the frame; usually the decision of which horizontal route to use is determined by the pattern and design of the racquet and stringing pattern to follow. Note; racquets have a specific stringing pattern that is decided by the company that manufactures that specific racquet. Since in our example we have 19 horizontal routes in our racquet; the operator is going to introduce the tip of the string into the holes of the racquet and through the horizontal routes 19 times all around. Visualize this, we have already 18 vertical strings in position within the frame of the racquet and we have 19 empty horizontal routes waiting for the strings to be pushed thru them. The intersection will start forming as soon as the horizontal strings enter the matrix.

As you can see, FIG. 4, remind us that the sample intersection is made of a vertical route and an horizontal route, with their respective strings 41, 42, a frame of a racquet 43, a hand of an operator H. Assuming that the first intersection the horizontal string encounters is the one on the drawing in FIG. 4; we know that the horizontal string 42 is going to be placed above the vertical string 41, on that intersection, please see FIG. 4. Don't confuse the routes with their covers, please. Since the first position for that horizontal string was above the vertical string, then in the next intersection on the same horizontal route, the horizontal string is going to be placed below the vertical string, then in the next intersection the horizontal string will be placed above the vertical string again, and so the pattern repeats itself until all the horizontal string come in contact will all the vertical strings out on the other end of that route, hole on the frame. The racquet has 19 horizontal holes on the side of the racquet, so the operator will push the horizontal string 19 times from hole to hole, from route to route until all the horizontal intersections are finish and all the horizontal strings are in their proper place and in the right order in the matrix or web of intersections within the frame of the racquet. We have now the entire vertical, horizontal strings with their respective intersections within the frame of the tennis racquet; now we make sure that they are no mistakes and that the strings are secure, so that we can travel with the racquet to the Pro-Shop or Tennis Center.

We mention before above that: "Only when all the strings are in place and only when all the intersections have been formed within the apparatus or Stringing Sandwich, is when the operator will take off the complementary overlay cover from the main section on the apparatus, and only at that moment in time, is when the complementary overlay cover will allow the openings on top of the main section to be exposed to the strings and to all the intersections that were created within the frame of the tennis racquet."; well, this is this moment we have being waiting for.

Figure 5:
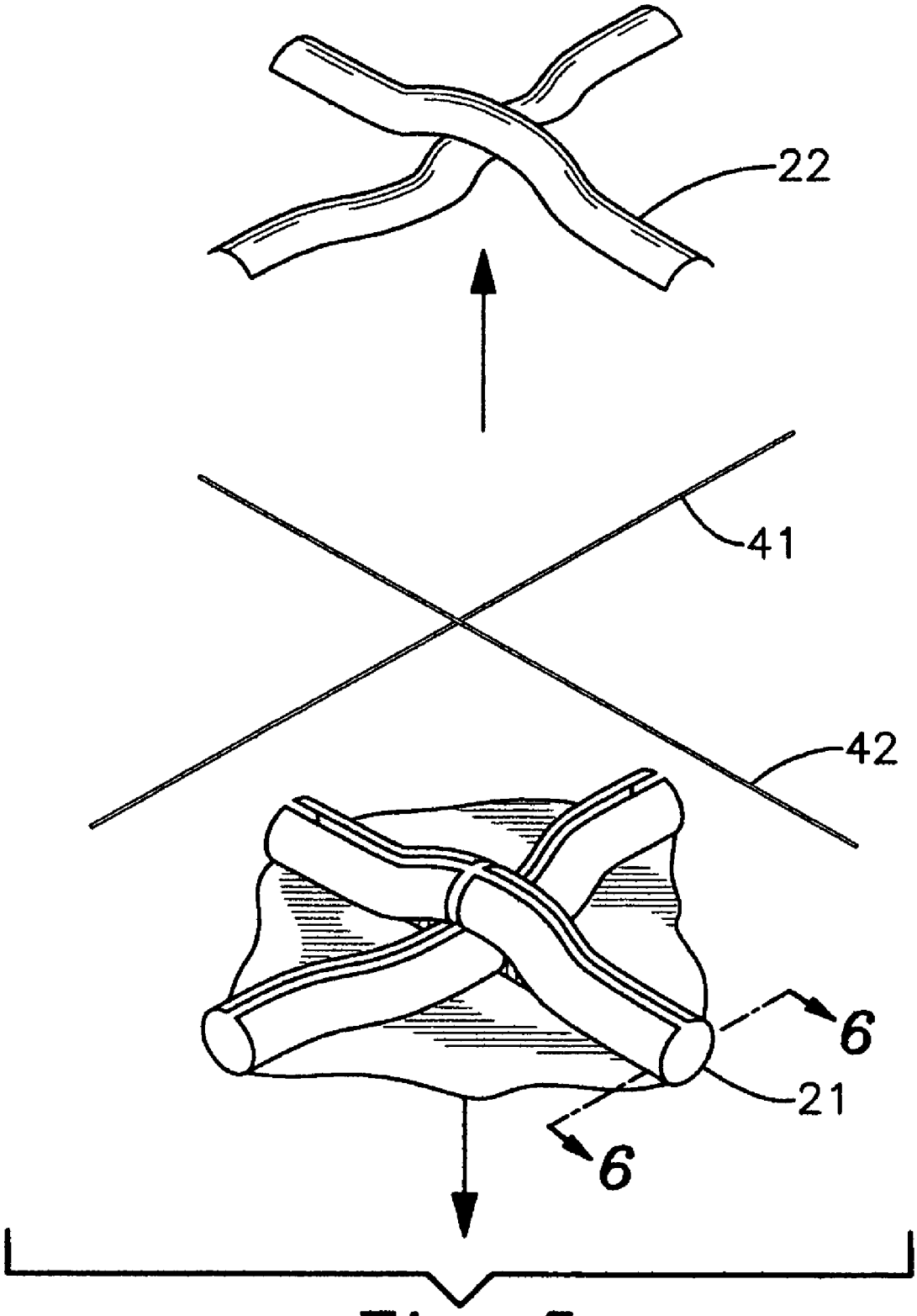
FIG. 5 shows the process of exit for the strings with their intersections from the main section of the apparatus, once the Stringing Sandwich is taken apart.
Figure 6:
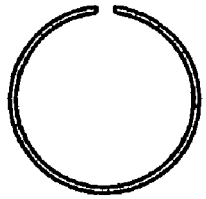
FIG. 6 shows a geometric pattern or design option for the routes that can be use on the apparatus.
Figure 7:
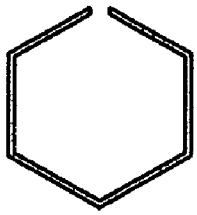
FIG. 7 shows a geometric pattern or design option for the routes that can be use on the apparatus.
Figure 8:
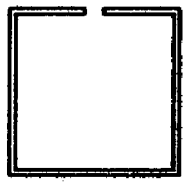
FIG. 8 shows a geometric pattern or design option for the routes that can be use on the apparatus.
Figure 9:
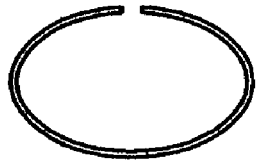
FIG. 9 shows a geometric pattern or design option for the routes that can be use on the apparatus.
Figure 10:
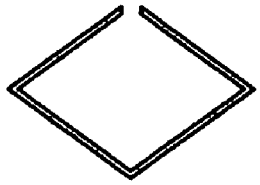
FIG. 10 shows a geometric pattern or design option for the routes that can be use on the apparatus.
Figure 11:
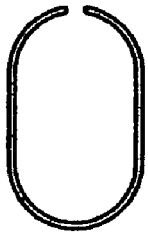
FIG. 11 shows a geometric pattern or design option for the routes that can be use on the apparatus.
Figure 12:
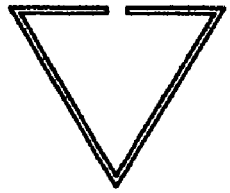
FIG. 12 shows a geometric pattern or design option for the routes that can be use on the apparatus.

The Outlet means, or openings on top of the main section, which are protected by the complementary overlay cover, are the means for the strings and their intersections to exit out from the apparatus or Stringing Sandwich. The operator is now ready to unclipped the complementary overlay cover from the main section and the grips that hold together the apparatus to itself and to the frame of the tennis racquet and let all the strings within the frame of the racquet. In FIG. 5, we see the undoing of the apparatus from the frame of the racquet; we see the complementary overlay cover 22, we see the vertical and horizontal string with their intersection in place 41, 42, we see the main section as it was before at the beginning 21, and we see the geometric type of route FIG. 6.

ADVANTAGES

Advantages of the Apparatus Next Again

The Stringing Sandwich is an apparatus that will guide/overlie the strings on top of each other within a frame of a racquet, thus providing an opportunity to avoid manual mistakes.

The apparatus also will assist the user in the stringing process before a racquet is taken to the stringing machine for the final tension on the strings, thus saving time and work.

The Stringing Sandwich is a product that is portable, easy to transport to any location.

The apparatus is easy to assemble and disassemble, thus convenient to work with and less stressful to the user.

The Stringing Sandwich is made of transparent plastic, thus allowing the user to visualize and to assess progress.

The apparatus allows itself to be used on the sales promotion purposes, such as designs, ideas and logos which can be incorporated into the product for advertising purposes.

DEFINITIONS

A few of the definitions used during the paper:

Stringing Sandwich is the name given for the apparatus that was mention on this paper; that is, the commercial name for the possible apparatus or product on the market, that I would use for the apparatus.

The stringing machine is a machine that applies the final pressure to the strings once the strings are in place secure within the frame of the tennis racquet.

Bouncing purposes means that, the tennis ball would bounce off from the racquet and toward the direction that the racquet is aimed at the moment of impact by a person.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus that lays strings on top of each other within a frame of a racquet comprising: a main section with vertical and horizontal routes that overpass each other; a complementary overlap cover for the vertical and horizontal routes of the main section; a means of securing and undoing the main section to and from the frame of the racquet; and an inlet and outlet means for the strings to and from the main section.

2. An apparatus that lays strings on top of each other within a frame of a racquet as claimed in claim 1 wherein said main section with vertical and horizontal routes that overpass each other is made of routes of any geometric shape or design.

3. An apparatus that lays strings on top of each other within a frame of a racquet as claimed in claim 1 wherein said main section with vertical and horizontal routes that overpass each other is made of any number of vertical and horizontal routes.

4. An apparatus that lays strings on top of each other within a frame of a racquet as claimed in claim 1 wherein said main section with vertical and horizontal routes that overpass each other is made of transparent plastic.

5. An apparatus that lays strings on top of each other within a frame of a racquet as claimed in claim 1 wherein said complementary overlap cover for the vertical and horizontal routes of the main section is made of any geometric shape.

6. An apparatus that lays strings on top of each other within a frame of a racquet as claimed in claim 5 wherein said is made of transparent plastic.

* * * * *